United States Patent [19]

Zollinger et al.

[11] Patent Number: 4,537,671

[45] Date of Patent: Aug. 27, 1985

[54] CATHODE POT OF AN ALUMINUM REDUCTION CELL

[75] Inventors: Max Zollinger, Wädenswil; Raoul Jemec, Benglen, both of Switzerland

[73] Assignee: Swiss Aluminium Ltd., Chippis, Switzerland

[21] Appl. No.: 511,266

[22] Filed: Jul. 6, 1983

[30] Foreign Application Priority Data

Jul. 12, 1982 [CH] Switzerland ..... 4249/82

[51] Int. Cl.[3] ..... C25C 3/08; C25C 17/00; C25B 11/12

[52] U.S. Cl. ..... 204/243 R; 204/279; 204/294; 373/137

[58] Field of Search ..... 204/243 R, 243 M-247, 204/67, 279, 294; 373/30, 27, 137

[56] References Cited

U.S. PATENT DOCUMENTS

| | | | |
|---|---|---|---|
| 3,514,520 | 5/1970 | Bacchiega et al. | 204/243 R |
| 4,124,476 | 11/1978 | Rapolthy | 204/243 R |
| 4,322,282 | 3/1982 | Jemec | 204/243 R |
| 4,339,316 | 7/1982 | Peterson et al. | 204/243 R |

*Primary Examiner*—Donald R. Valentine
*Attorney, Agent, or Firm*—Bachman & LaPointe

[57] ABSTRACT

A fused salt reduction cell for producing aluminum comprises a cathode pot having an outer steel shell supported on or by metal structural parts, a thermally insulating layer and an inner lining which is of carbon, is electrically conductive and is resistant to attack by the molten aluminum and the electrolyte.

In the region of the electrolyte there is a layer which runs horizontally around the cell dividing the carbon lining into a lower part and an upper part. This layer is of a material which is resistant to the electrolyte at temperatures up to 1000° C. and has a much lower shear strength than that of the carbon lining.

17 Claims, 5 Drawing Figures

CATHODE POT OF AN ALUMINUM REDUCTION CELL

BACKGROUND OF THE INVENTION

The invention relates to a cathode pot of a fused salt reduction cell for the electrolytic production of aluminum comprising a steel shell supported by or reinforced with metal structural parts, a thermally insulating layer and an inner lining which is of carbon, is electrically conductive and resistant to attack by the molten aluminum and the electrolyte.

In the fused salt reduction process for producing aluminum from aluminum oxide the latter is dissolved in a fluoride melt comprised for the greater part of cryolite. The cathodically precipitated aluminum collects under the fluoride melt on the carbon floor of the cell, the surface of the molten aluminum forming the actual cathode. Dipping into the electrolyte from above are anodes which in conventional processes are made of amorphous carbon. At the carbon anodes, as a result of the electrolytic decomposition of the aluminum oxide, oxygen is formed; this oxygen combines with the carbon of the anodes to form $CO_2$ and CO. The electrolytic process takes place in a temperature range extending from approximately 940° C. to 970° C.

During the operation of the cell, the carbon lining experiences a significant increase in volume. This is caused by the penetration of components from the electrolyte into the carbon lining. By components here is to be understood for example sodium or salts of which the fluoride melt is made up, and also chemical compounds which are formed in the fluoride melt via reactions which are not well understood.

Two other specific, important factors which influence the swelling of the cathode carbon during cell operation are:

The applied current density: the higher the current density, the greater is the increase in volume.

The quality of the carbon: the higher the degree of graphitization, the smaller is the increase in volume.

As it swells, the carbon lining presses against the thermal insulation and thus indirectly on the steel shell. This can result in irreversible deformation which can deform the steel plastically and even result in cracking of the same.

The tendency for the carbon base to swell increases with the age of the cell; cracks form as a result of this swelling. The molten aluminum can penetrate these cracks and attack the iron cathode bars which conduct away the direct electric current. The disruption of the cell lining can progress to such a stage that the liquid aluminum runs out of the cell. In that case the cell must usually be put out of service prematurely. Such an event leads to expensive repairs and of course incurs a loss of production during the down time of the cell.

Numerous attempts have been made in the past to avoid deformation cracks in the carbon floor of the cell by providing reinforcement to the steel shell. As a rule, however, these events could as a result not be prevented but simply lessened. Furthermore, such reinforcement of the cell suffers the disadvantage of adding expense so that the cell becomes more expensive and at the same time the overall weight of the cell is considerably increased.

Other efforts have been aimed at saturating the carbon lining with electrolyte components in advance in order to prevent a subsequent increase in volume. It has been shown however that these volume increases cannot be avoided and must be accepted as unavoidable. Proposed in the U.S. Pat. No. 4,124,476 is to provide a curvature in the steel shell. This comprises a space filled completely first with an easily formable material and secondly with a material which deforms only when large forces are applied to it; the said space accommodates the floor of the carbon lining which expands in the horizontal direction during operation of the cell. The second mentioned material exhibits such properties that the forces in question are transferred to the curved steel shell without permanent deformation and/or crack formation occurring. The counter-forces acting on the floor of the carbon lining diminish its swelling/doming and propagation of cracks through it.

Although the state of the art proposals, in particular those in the above mentioned U.S. Pat. No. 4,124,476, are of some assistance, there still exist great problems with very high current cells.

It is therefore an object of the present invention to develop a new concept for a cathode pot of a fused salt reduction cell for the production of aluminum, such that uncontrolled deformation can be prevented in cells of all size, and such that the cells will not suffer damage in the form of crack formation. The concept is intended to be realized with lower investment costs and to be flexibly applicable.

SUMMARY OF THE INVENTION

The foregoing object is achieved by way of the invention by the provision of a layer which runs horizontal and exclusively in the region around the electrolyte, dividing the carbon lining into a lower and an upper part, said layer being of a material which can withstand temperatures up to 1000° C., is resistant to attack by the electrolyte and has a significantly lower shear strength than the carbon lining.

Using this concept the sidewall of the carbon lining is divided. The electric field between the cathode bars and the anodes runs through the floor and the lower part of the sidewall of the carbon lining. On the other hand practically no electric current flows through the part of the sidewall of the carbon lining above the low shear strength layer. Consequently the lower part of the carbon lining swells much more than the upper part. The resultant stresses are accommodated by the low shear strength layer fracturing. As this lies completely at the level of the molten electrolyte, no liquid aluminum can enter the cracks formed.

The pre-determined fracture in the low shear strength layer is self-healing as the molten electrolyte penetrating the crack cools down in to such an extent in the outer region of the wall that it solidifies and prevents electrolyte leaking out.

The self-healing of the pre-determined fracture zone can be improved by providing a very good thermally conductive material immediately outside the low shear strength layer and the region of the lower adjacent carbon lining, and such that this thermally conductive material runs as a "thermal collector" or heat sink zone along the direction of the sidewall of the outer steel shell. This enables the heat from the electrolyte penetrating the crack to be led away faster so that the self-healing via solidification takes place faster. Usefully the upper limit of this heat collecting zone is at about the same level as the upper limit of the low shear strength layer. The heat collecting zone, however, is thicker than this layer—usefully two to three times as thick as the low shear strength layer. Metallic materials, for example steel wool or aluminum chips, are particularly suitable for rapid withdrawal of heat into the heat collector zone.

In order that the cracks always form in the desired region, the shear strength of the layer which separates the carbon lining into an upper and lower part is preferably at least five times lower than that of carbon.

The thickness of the low shear strength layer lies in practice usefully between 2 and 15 cm, preferably between 5 and 10 cm.

The layer which divides the carbon lining into two parts is usefully made up of pre-fabricated blocks. The materials for these blocks must fulfill three requirements viz., be resistant to high temperature, resistant to the electrolyte and exhibit low shear strength. In practice the blocks can be made of foamed carbon, foamed ceramic materials and compressed carbon fiber layers.

The low shear strength material is usefully bonded at the top, using a known adhesive, to the carbon lining and at the bottom laid on the carbon lining but with a carbon felt between. The compressed carbon felt is usefully between 5 and 15 mm thick and at the bottom adhesively bonded to the carbon lining.

If the lower part of the carbon lining should swell up less quickly, then this lower part can be more highly graphitized.

It has also been shown to be of advantage to place in the region of the floor of the carbon lining plastically formable metal parts or brittle porous materials which produce an almost constant resistance when the floor expands. These so-called crunch elements usefully lie above the core zone of the floor of the carbon lining. This has the result of preventing cracks and excessive deformation in an undesireable position. The negative effect of any cracks present in the region of the floor of the carbon lining is usefully diminished or prevented by pre-stressing the crunch elements by known means.

Usefully upright lengths of pipe or groups thereof are employed for the plastically formable metal parts. Instead of high quality plastically formable metal a preferred version of the crunch elements can be provided in the form of relatively brittle materials featuring innumerable small pores. On crushing such a material the—to the naked eye almost invisible—material bridging the pores breaks in succession, whereas the rest—still intact zones—offers almost constant resistance to the expanding lower part of the carbon lining.

BRIEF DESCRIPTION OF THE DRAWINGS

The invention is described in greater detail in the following description with the help of schematic drawings wherein.

DETAILED DESCRIPTION

Figure 1:
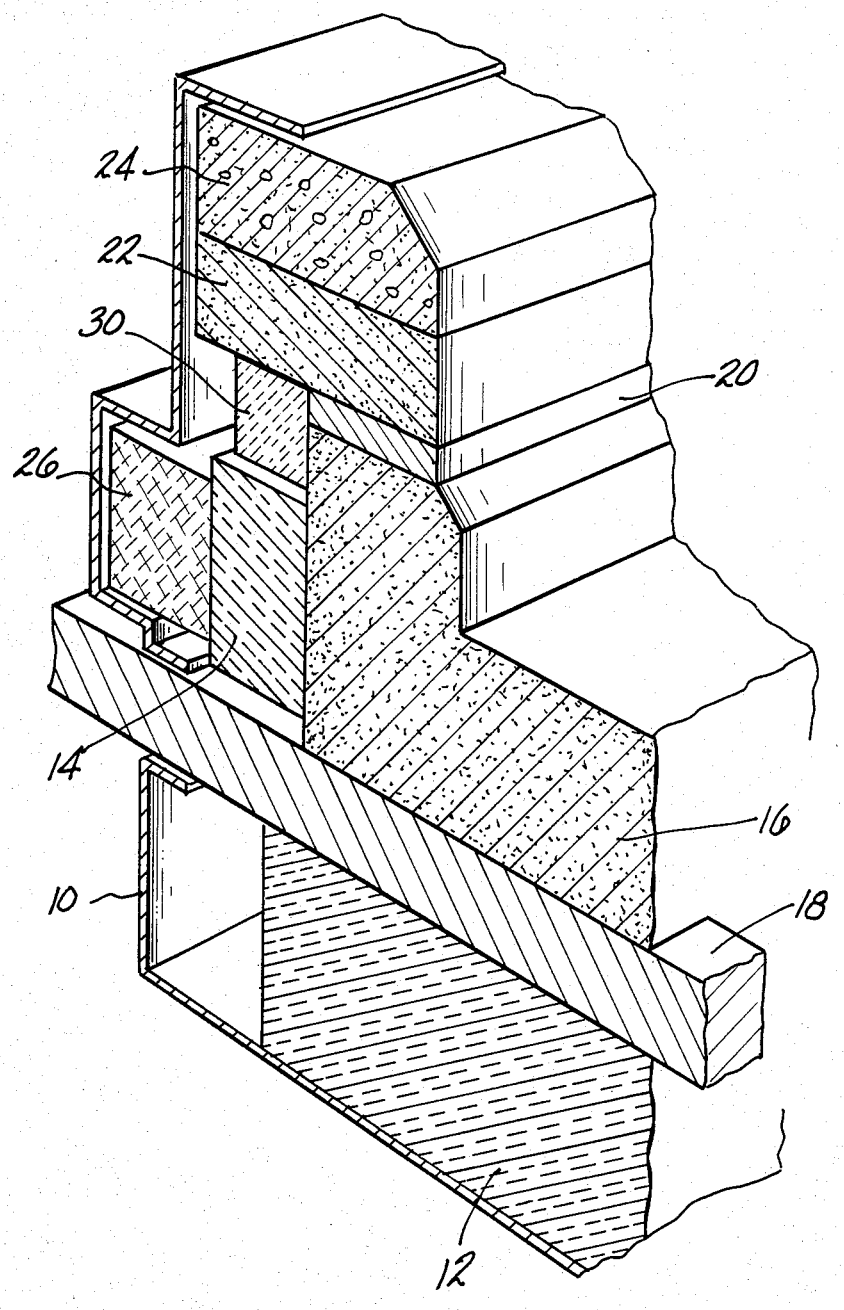
FIG. 1: A sectioned perspective view of the side region of a fused salt reduction cell used for the production of aluminum.

A fused salt reduction cell for producing aluminum features an outer steel shell 10. Bedded inside that is the lower insulation 12 and the sidewall insulation 14. On top of the lower insulation 12 is the lower part 16 of the carbon lining with cast-in iron cathode bars 18. Provided on the horizontally limited edge region of the lower part 16 of the carbon lining is the approximately 8 cm thick layer 20 of low shear strength material. Between this layer 20 and the lower part 16 of the carbon lining—but not shown here—is a pad of carbon felt which is bonded adhesively to the lower part 16 of the carbon lining.

The upper part 22 of the carbon lining is bonded adhesively on top of the low shear strength layer 20, the former projects out further than the lower part 16. Stone blocks 24 form the uppermost part and provide an insulating layer which also protects the edge of the pot from attack by oxygen in the surrounding air.

Inside the steel tank 10 at the level of the upper region of the carbon lining floor are pre-stressed crunch elements 26 which are supported by appropriately shaped parts of the steel shell 10.

The crunch elements 26 provide a constant, displacement-independent resistance to the expanding lower part 16 of the carbon lining.

Between the insulation 14 at the side and the upper part 12 of the carbon lining is a highly thermal conductive layer which acts as a heat sink 30. This runs vertically downwards past the low shear strength layer 20 and part of the lower part 16 of the carbon lining.

Figure 2:
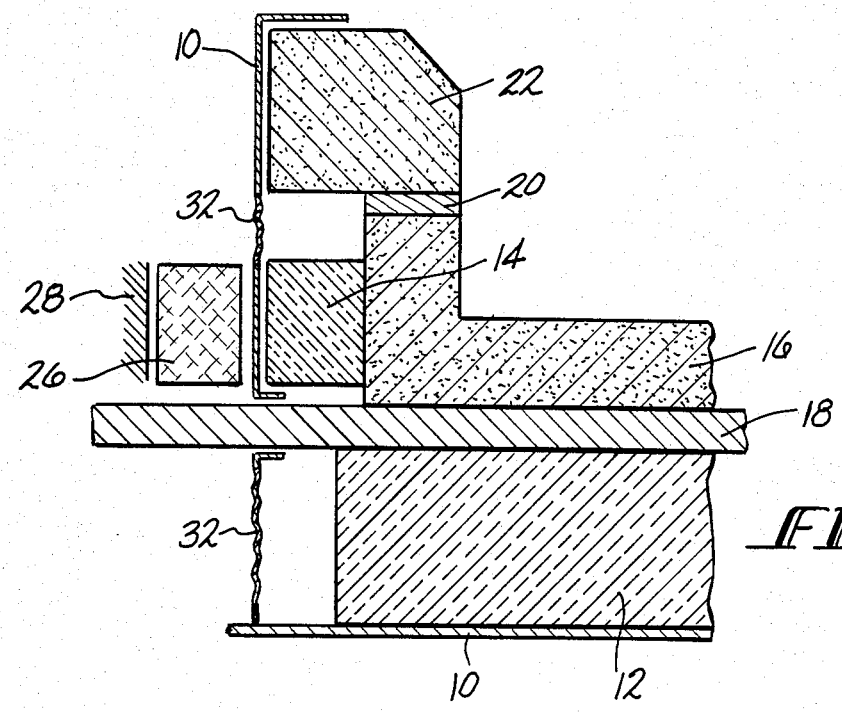
FIG. 2: A vertical section through the side region of a fused salt reduction cell used for the production of aluminum.

In FIG. 2 a part of the side of the steel shell 10 has been replaced by a flexible wall 32. For this one can employ for example a "fabric" of carbon fibers which are combined in layer upon layer sandwich fashion with metal foils. The pre-stressed crunch elements 26 positioned outside the flexible wall 32 are made up, as in FIG. 1, of packets of plastically formable vertical pipes. On the outside the crunch elements 26 are supported by a solid backing 28. A layer promoting slip can be provided between the flexible wall 32 and the insulation at the side.

Figure 3:
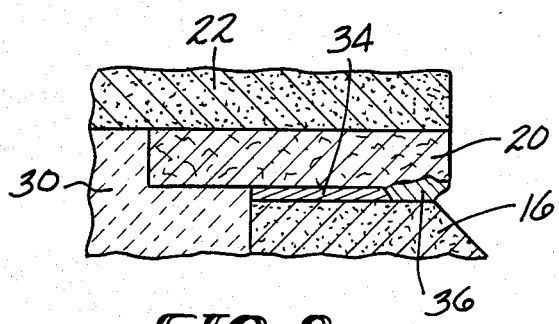
FIG. 3: A vertical section showing a detail in the region of the low shear strength layer after the first cracking has occurred.

FIG. 3 shows a foamed carbon block 20 of low shear strength resting on a pad 34 of carbon felt. Because of the difference in degree of expansion experienced by the lower part 16 and the upper part 22 of the carbon lining, the low shear strength layer has cracked once; molten electrolyte has penetrated the crack and partly solidified there.

Figure 4:
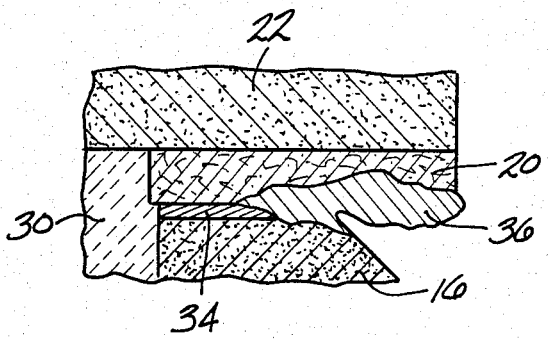
FIG. 4: A section as shown in FIG. 3 after x cracks have formed.

Whereas the low shear strength layer has cracked once in FIG. 3, in FIG. 4 it has already fractured a number of times. The carbon felt pad 34 has been partly removed and the solidified electrolyte 36 has penetrated further towards the outside of the lining.

Figure 5:
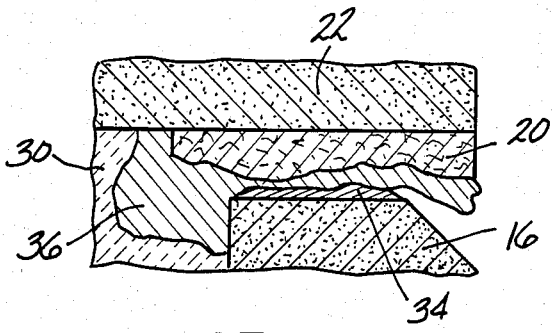
FIG. 5: A section as in FIGS. 3 and 4 after full penetration of the cracks through the low shear strength layer.

In FIG. 5 the molten electrolyte has, finally, fully penetrated the low shear strength layer 20 and has solidified in the heat sink 30 zone.

FIGS. 3–5 show clearly—in cells having component parts of different dimensions—the self-healing effect of the pre-determined shear zone. The pot containing molten electrolyte and precipitated aluminum can fracture only at one place viz., the low shear strength layer 20. In this region there is only molten electrolyte—no metal. The electrolyte penetrating the crack in this layer 20 solidifies, and although it continues to progress further outwards, has the property of being self-healing in that the solidified material prevents molten electrolyte behind it from leaking out of the cell.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A cathode pot of a fused salt reduction cell comprising an outer steel shell, a thermally insulating layer and an inner lining made of carbon, the improvement comprising a low shear strength electrolyte resistant layer which runs horizontally around the cell and exclusively arranged at the level of the electrolyte to which it is resistant for dividing the carbon lining into a lower part and an upper part such that the electric field in the cell runs through the lower part of said carbon lining thereby resulting in swelling of the lower part of said carbon lining to a greater degree than said upper part of the carbon lining wherein the resultant stresses due to the swelling are accommodated by the fracturing of said low shear strength elctrolyte resistant layer wherein said layer is formed of a material characterized by the ability to withstand temperatures up to 1000° C. and a shear strength significantly lower than that of the carbon lining.

2. A cathode pot according to claim 1 wherein the shear strength of the layer dividing the carbon lining is at least five times smaller than that of the carbon lining.

3. A cathode pot according to claim 1 wherein the layer is 2–15 cm thick.

4. A cathode pot according to claim 1 wherein the layer is 5–10 cm thick.

5. A cathode pot according to claim 1 wherein the layer is made of foamed carbon.

6. A cathode pot according to claim 1 wherein the layer is made of layers of carbon fiber.

7. A cathode pot according to claim 1 wherein the layer is made of foamed ceramic material.

8. A cathode pot according to claim 1 wherein the layer is bonded by adhesive to the upper part of the carbon lining and rests on the lower part of the carbon lining.

9. A cathode pot according to claim 8 wherein a carbon felt is provided between the layer and the lower part of the carbon lining.

10. A cathode pot according to claim 9 wherein the carbon felt is 5–15 mm thick and is bonded to the lower part of the carbon lining by an adhesive.

11. A cathode pot according to claim 1 wherein a heat sink is provided immediately outside the layer and adjacent to the lower part of the carbon lining.

12. A cathode pot according to claim 11 wherein the heat sink is formed of a highly thermal conductive material and runs in the direction of the sidewall of the outer steel shell wherein the height of the heat sink is from two to three times the thickness of the layer.

13. A cathode pot according to claim 11 wherein the heat sink is made of steel wool.

14. A cathode pot according to claim 11 wherein the heat sink is made of aluminum chips.

15. A cathode pot according to claim 1 wherein the lower part of the carbon lining is more highly graphitized than the upper part.

16. A cathode pot according to claim 1 wherein there are crunch elements situated in the region of the floor of the lower part of the carbon lining, said crunch elements being in the form of plastically formable metal pipes.

17. A cathode pot according to claim 16 wherein the crunch elements are prestressed.

* * * * *